US010815997B2

(12) United States Patent
Patwardhan et al.

(10) Patent No.: US 10,815,997 B2
(45) Date of Patent: Oct. 27, 2020

(54) METHOD FOR REGULATING THE ROTATIONAL SPEED OF A COMPRESSOR AS A FUNCTION OF THE AVAILABLE GAS FLOW OF A SOURCE AND REGULATION THEREBY APPLIED

(71) Applicant: ATLAS COPCO AIRPOWER, NAAMLOZE VENNOOTSCHAP, Wilrijk (BE)

(72) Inventors: Subodh Sharadchandra Patwardhan, Wilrijk (BE); Hans Theo Magits, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 285 days.

(21) Appl. No.: 15/755,273

(22) PCT Filed: Aug. 11, 2016

(86) PCT No.: PCT/BE2016/000039
§ 371 (c)(1),
(2) Date: Feb. 26, 2018

(87) PCT Pub. No.: WO2017/035609
PCT Pub. Date: Mar. 9, 2017

(65) Prior Publication Data

US 2018/0283379 A1 Oct. 4, 2018

(30) Foreign Application Priority Data

Aug. 31, 2015 (BE) ..... 2015/5555

(51) Int. Cl.
*F04C 28/08* (2006.01)
*F04C 28/28* (2006.01)
(Continued)

(52) U.S. Cl.
CPC ..... *F04C 28/08* (2013.01); *F04B 27/24* (2013.01); *F04B 49/065* (2013.01);
(Continued)

(58) Field of Classification Search
CPC ..... F04C 2270/051; F04C 2270/60; F04C 2270/025; F04C 2270/0525; F04C 227/02;
(Continued)

(56) References Cited

U.S. PATENT DOCUMENTS 4,526,513 A * 7/1985 Bogel ..... F04B 49/02 417/18
4,608,833 A * 9/1986 Kountz ..... F04D 27/0284 62/201
(Continued)

FOREIGN PATENT DOCUMENTS

CN 104421142 A 3/2015
DE 102009017887 A1 10/2010
(Continued)

OTHER PUBLICATIONS

International Preliminary Report on Patentability dated Nov. 17, 2017 on PCT/BE2016/000039.
(Continued)

*Primary Examiner* — Bryan M Lettman
*Assistant Examiner* — Timothy P Solak
(74) *Attorney, Agent, or Firm* — Bacon & Thomas, PLLC

(57) ABSTRACT

A method for controlling the speed of a compressor with a controller as a function of the available gas flow. The method includes the steps of setting a desired value for the inlet pressure; determining the inlet pressure; and determining the speed. The method further includes controlling the speed of the compressor by reducing or increasing it depending on whether the inlet pressure is less than or greater than a set
(Continued)

desired value until the inlet pressure is equal to the set desired value where the characteristic data of the compressor relating to the efficiency and/or the Specific Energy Requirement (SER) as a function of the speed and the inlet pressure is provided and the desired value of the inlet pressure is adjusted on the basis of the aforementioned characteristic data so that the efficiency of the compressor is a maximum or the SER is a minimum.

16 Claims, 4 Drawing Sheets

(51) Int. Cl.

| | |
|---|---|
| ***F04D 27/00*** | (2006.01) |
| ***F04B 27/24*** | (2006.01) |
| ***F04B 49/06*** | (2006.01) |
| ***F04B 49/10*** | (2006.01) |
| ***F04C 18/16*** | (2006.01) |

(52) U.S. Cl.
CPC ..... *F04B 49/103* (2013.01); *F04C 18/16* (2013.01); *F04C 28/28* (2013.01); *F04D 27/004* (2013.01); *F04B 2203/0209* (2013.01); *F04B 2205/02* (2013.01); *F04B 2207/044* (2013.01); *F04C 2270/02* (2013.01); *F04C 2270/025* (2013.01); *F04C 2270/051* (2013.01); *F04C 2270/0525* (2013.01); *F04C 2270/095* (2013.01); *F04C 2270/18* (2013.01); *F04C 2270/205* (2013.01); *F04C 2270/42* (2013.01); *F04C 2270/48* (2013.01); *F04C 2270/60* (2013.01)

(58) Field of Classification Search
CPC ..... F04C 2270/42; F04C 2270/05; F04C 2270/095; F04C 2270/185; F04C 2270/205; F04C 2270/20; F04C 2270/48; F04C 2270/02; F04B 27/24; F04B 2205/02; F04B 2207/044; F04B 2207/047
See application file for complete search history.

(56) References Cited

U.S. PATENT DOCUMENTS

| | | | | |
|---|---|---|---|---|
| 5,203,179 | A * | 4/1993 | Powell | F04D 27/0261 62/180 |
| 6,516,622 | B1 | 2/2003 | Wilson | |
| 2001/0054294 | A1* | 12/2001 | Tsuboi | F04C 28/08 62/228.4 |
| 2002/0051709 | A1 | 5/2002 | Nishimura | |
| 2008/0085180 | A1* | 4/2008 | MacKenzie | F04C 18/16 415/31 |
| 2010/0095670 | A1 | 4/2010 | Grzonkowski et al. | |
| 2010/0115800 | A1* | 5/2010 | Sakai | F04B 49/06 37/348 |
| 2012/0134866 | A1* | 5/2012 | Tsuboi | F04C 18/16 418/201.1 |

FOREIGN PATENT DOCUMENTS

| | | | |
|---|---|---|---|
| DE | 102011079732 | A1 | 1/2013 |
| FR | 2792083 | A1 | 10/2000 |
| GB | 2502134 | A | 11/2013 |
| JP | H0742957 | B2 | 5/1995 |
| JP | 2007177670 | A | 7/2007 |
| KR | 10-2008-0106972 | | 12/2008 |

OTHER PUBLICATIONS

Belgian Search Report dated Apr. 22, 2016 on 2015/05555.
International Search Report dated Feb. 28, 2017 on PCT/BE2016/000039.

* cited by examiner

METHOD FOR REGULATING THE ROTATIONAL SPEED OF A COMPRESSOR AS A FUNCTION OF THE AVAILABLE GAS FLOW OF A SOURCE AND REGULATION THEREBY APPLIED

The present invention relates to a method for controlling the speed of a compressor as a function of the available gas flow originating from a source and a controller and compressor thereby applied.

More specifically, the invention is intended for screw compressors, but it is not limited to them.

BACKGROUND OF THE INVENTION

Due to their high reliability, screw compressors are often used in sectors of industry where gases are produced or extracted such as in the sectors of biogas production, natural gas extraction, CNG applications, CO2 supplies for the food industry and fertiliser industry, hydrogen supplies and similar.

The available flow of gas originating from the source is often highly variable and must be compressed for supply to a downstream network of users, typically up to 18 bars in the event of biogas production.

Of course it must be the intention to be able to supply the maximum available flow from the source to the downstream network, but compressors have their limitations with regard to the permissible pressure in the inlet, which by design is limited to between 1 and 4 bars for example.

Various methods are already known for controlling compressors in such applications in which the available gas flow to be compressed varies.

For example, a first method is known for compressors with a fixed speed whereby the compressor is switched on and off when the available flow falls below an expected nominal value or rises above an expected value. For compressors with a fixed speed it is also known to bring a bypass into operation in order to bypass the compressor when the available flow is too low. The frequent switching on and off has a negative impact on the lifetime of the compressor.

It goes without saying that with such a limited control it does not have the possibilities to set up the most energy-efficient control in all circumstances.

Moreover, with such a control with a fixed speed when the available gas flow rises above the aforementioned nominal value, the inlet pressure will rise until the inlet pressure has reached its maximum permissible value. If in that case the available flow increases further, measures have to be taken with this control to stop the inlet pressure rising further, whereby these measures always come with energy losses. Moreover, as a result the production capacity of the gas source is restricted by the compressor.

A second known method makes use of a compressor with a controllable variable speed, also known as a VSD (Variable Speed Drive) compressor.

This second method comprises the following steps:

- the imposition of a desired value for the inlet pressure at the inlet of the compressor;
- the determination of the inlet pressure at the inlet of the compressor;
- the determination of the speed of the compressor;
- the control of the speed of the compressor by reducing the speed when the inlet pressure is less than the set desired value of the inlet pressure, or by increasing the speed when the inlet pressure is greater than the set desired value of the inlet pressure, and this until the inlet pressure is equal to the set desired value.

With this method, when the available gas flow increases at a certain speed of the compressor, the inlet pressure at the inlet of the compressor also increases. The aforementioned control of the speed as a function of the inlet pressure will ensure that the speed increases until the inlet pressure recovers to the level of the set desired value. Due to the increase of the speed, the increased available gas flow will be fully compressed by the compressor and supplied to the network. The same logic can be followed in reverse in the event of a decrease of the available gas flow.

This known method provides the advantage that it ensures that, within imposed minimum and maximum limits of the compressor speed, the entire available flow can always be supplied/sold to the network such that maximum productivity of the gas source can always be ensured.

An additional advantage of this second method with control of the speed is that with an available gas flow that is low, the power supplied to the compressor corresponds to the compression capacity of the gas flow, such that all energy supplied to the compressor is usefully utilised for the compression and thus no valuable energy is lost.

Another advantage is that the continuous control of the speed prevents the compressor from having to be switched on and off frequently, which is beneficial for the lifetime of the compressor.

However, a disadvantage is that the controller will always endeavour to control the speed as a function of the set inlet pressure and to maintain the inlet pressure at the set value, without the controller taking account of a maximum efficiency of the compressor consumption that can be expressed in terms of the compressor efficiency or in terms of the 'SER' (Specific Energy Requirement), which is the ratio of the power supplied to the compressor to the compressed gas flow supplied, and is expressed in Joules/normal litre for, example.

Especially when the maximum permissible speed of the compressor is reached with the control for a set inlet pressure, the compressor will operate very inefficiently as in this case an increase of the available gas flow will result in the compressor continuing to run at this maximum speed and the inlet pressure will rise to its maximum permissible value.

SUMMARY OF THE INVENTION

The purpose of the present invention is to provide a solution to one or more of the aforementioned and other disadvantages.

To this end the invention concerns a method corresponding to the second method described above, but whereby the method according to the invention comprises the following additional steps:

- the provision of the characteristic data of the compressor relating to the efficiency and/or the SER (specific energy requirement) as a function of the speed and the inlet pressure;
- the adjustment of the desired value of the inlet pressure on the basis of the aforementioned characteristic data and in such a way that after the aforementioned control of the speed at the adjusted desired value of the inlet pressure, the efficiency of the compressor is a maximum or the SER is a minimum.

This method according to the invention thus combines the advantages of the known method with regard to the full utilisation of the available gas flow for the supply to the network, combined with the continuous aim for the most efficient energy consumption for the drive of the compressor for compressing this entire available gas flow.

For the application of the method according to the invention, the aforementioned characteristic data of the compressor concerned can preferably be determined beforehand, for example during production or already during the design, and then loaded in the memory of the controller.

In the case of a compressor whereby the characteristic data are not known beforehand, it is possible to determine these data experimentally on an ad hoc basis by determining the efficiency and/or the SER for successive steady operating points during the use of the compressor, and storing them in the memory as a function of the speed and the inlet pressure.

This can be done during the normal use of the compressor by determining the SER whenever it reaches a steady situation with a certain inlet pressure and speed, and then loading it in the memory for each new steady state or to update existing data.

In this way a graph or table of the characteristic data of the compressor is built up point by point and is continually updated.

The controller is thus self-learning such that the data in the memory automatically take account of any signs of wear and other phenomena that affect the efficiency and the SER.

Preferably at least during the commissioning of the compressor, the characteristic data of the compressor concerned are determined over the entire operating region of the compressor and are stored in the memory.

According to a preferred aspect, to determine the characteristic data of the compressor concerned over the entire operating region, the controller is provided with a program to have the compressor operate successively at different discrete operating points within the aforementioned operating region by setting the corresponding desired value of the inlet pressure and the speed for each operating point, for example in incremental steps.

Industrial processes where gas is produced often have to contend with harsh and changeable conditions. In these applications, preference is often given to reliable compressors such as screw compressors, rather than being concerned with efficient energy consumption. Thanks to the invention it is now also possible to choose this type of compressor, not only for its reliability, but also for its efficient application possibilities.

The invention also relates to a controller for controlling the speed of a compressor as a function of the available gas flow originating from a gas source that enables the method according to the invention to proceed autonomously.

To this end the invention concerns a controller that is provided with:

- an input for a signal that is representative of the inlet pressure $p_{in}$ at the inlet of the compressor;
- an input for a signal that is representative of the speed n of the compressor;
- a desired value $p_{set}$ to be set for the inlet pressure $p_{in}$; and,
- an algorithm for controlling the speed (n) of the compressor by reducing the speed n when the inlet pressure is less than the set desired value of the inlet pressure, or by increasing the speed when the inlet pressure is greater than the set desired value of the inlet pressure, and this until the inlet pressure is equal to the set desired value, with the characteristic that the controller is further provided with:

- a memory in which the characteristic data of the compressor are stored or can be stored that relate to the efficiency and/or the SER (specific energy requirement) of the compressor as a function of the speed and the inlet pressure; and,
- an additional algorithm to adjust the aforementioned desired value of the inlet pressure, on the basis of the aforementioned characteristic data in the memory, in such a way that after the aforementioned control of the speed at the adjusted desired value of the inlet pressure the efficiency of the compressor is a maximum or the SER is a minimum.

Preferably the controller is also provided with an algorithm to automatically determine the aforementioned characteristic data of the compressor concerned during the use of the compressor and to store them in the memory of the controller point by point.

This provides the advantage that the controller can be applied to any compressor, even without knowing the characteristic data of the compressor concerned or without these characteristics first having to be determined experimentally.

To this end the controller is provided with an additional input for a signal that is representative of the power supplied to the compressor, whereby this signal can be used by the algorithm to determine the efficiency and/or the SER and to store them in the memory with the characteristic data as a function of the speed and the inlet pressure.

Optionally the controller can be provided with a program to allow the compressor to operate autonomously at different successive operating points within the operating region of the compressor by setting the corresponding desired value of the inlet pressure and the speed for each operating point, for example in incremental steps.

For the commissioning of a compressor whose characteristics are not known, this enables these characteristics to be mapped out for the application of the method according to the invention.

Of course the invention also relates to a compressor that is provided with such a controller according to the invention and to the use of such a compressor for the supply of gas originating from a source with a variable available flow with the aim, within certain limits, of being able to supply the entire available gas flow from the source to a downstream network of users with the highest possible efficiency and/or the lowest possible SER.

BRIEF DESCRIPTION OF THE DRAWINGS

With the intention of better showing the characteristics of the invention, a few preferred applications of the method according to the invention for controlling the speed of a compressor as a function of the available gas flow and a controller and compressor thereby applied are described hereinafter, by way of an example without any limiting nature, with reference to the accompanying drawings, wherein.

DETAILED DESCRIPTION OF THE INVENTION

Figure 1:
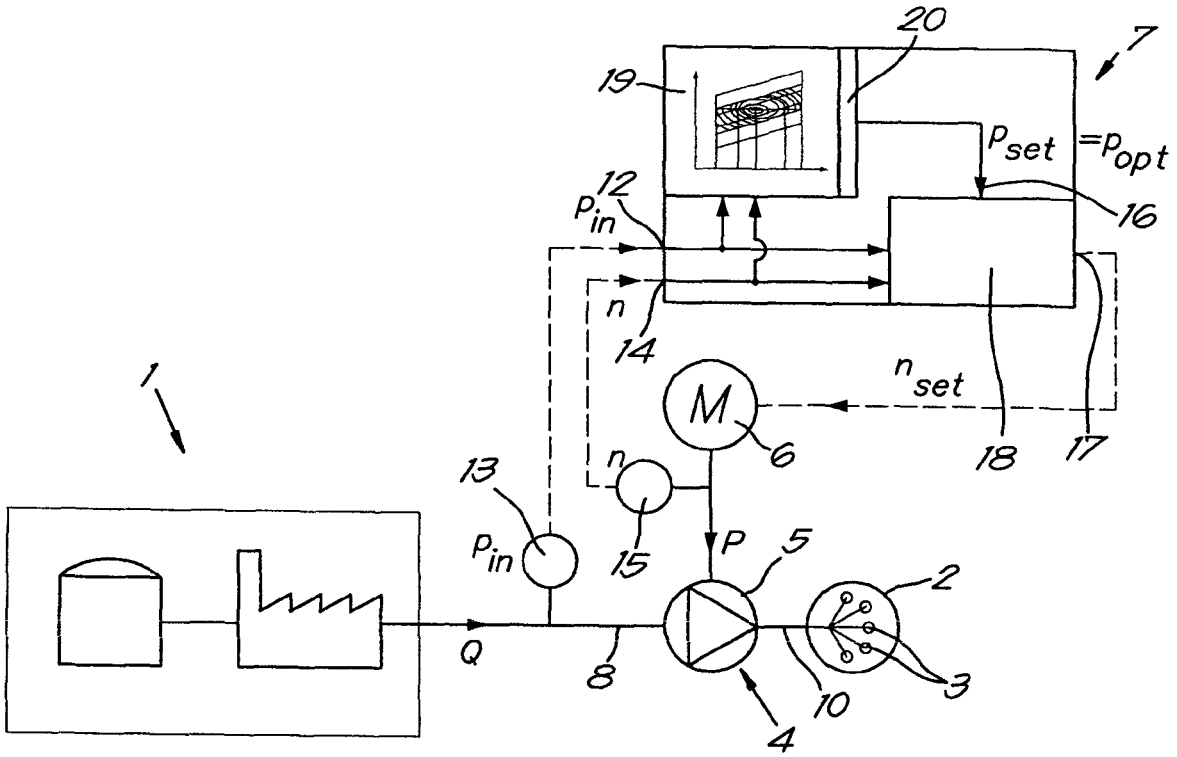
FIG. 1 schematically shows a perspective view of a compressor according to the invention set up in an industrial environment where biogases are produced to be supplied to a consumer network.

By way of an example, FIG. 1 shows a source 1 of gas in the form of an industrial installation 1 for the production of biogas.

It is typical for such an installation that the available produced quantity of gas varies over time and thus also the available flow Q for the supply of the biogas to a network 2 of consumers 3.

It is of course the intention of the producer of the biogas to be able to sell the entire available flow Q to the consumers 3 to a maximum.

For the supply of the biogas, this first pressure of this biogas has to be increased, in this case by making use of a compressor 4 with a compressor element 5 driven by a motor 6 with variable speed and provided with a controller 7 according to the invention for controlling the speed n.

The compressor element 5 is a screw compressor for example, whose characteristics are shown very schematically in the graphs of FIGS. 2 to 7, which were drawn up experimentally beforehand, for example, for the compressor element 5 concerned for different imposed operating regimes within the operating region of the compressor element 5.

This operating region is bounded by a minimum and a maximum permissible speed, $n_{min}$ and $m_{max}$ respectively, and a minimum and maximum permissible inlet pressure $p_{in}$ at the inlet 8 of the compressor element 5, $p_{inmin}$ and $p_{inmax}$ respectively, for which the compressor element 5 has been designed.

Figure 2:
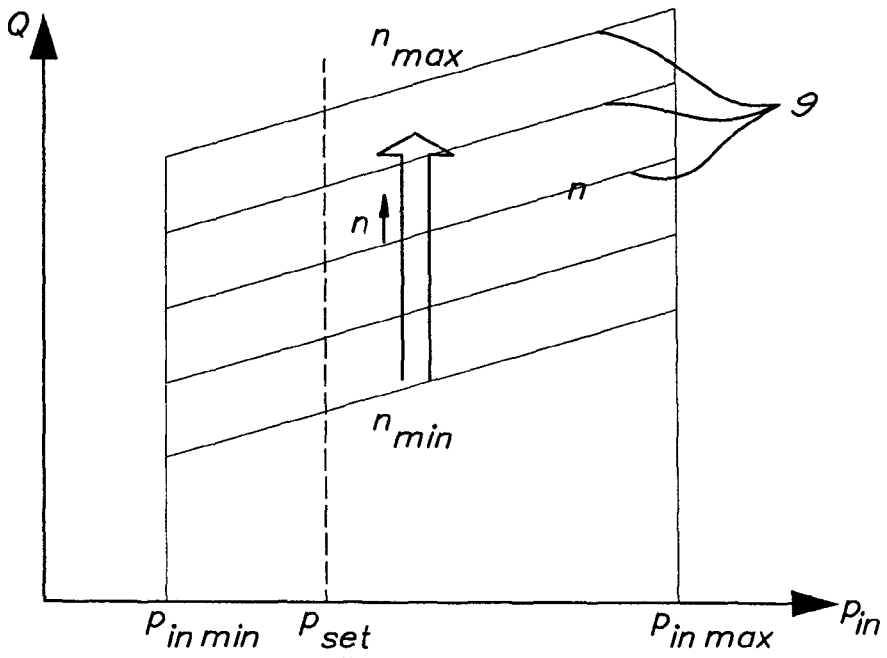
FIGS. 2 to 7 show a few simplified graphs relating to the characteristic data of the compressor of FIG. 1.

FIG. 2 shows, within the aforementioned operating region, the operating lines 9 of the flow Q as a function of the inlet pressure $p_{in}$, each time for a certain speed n of the compressor element 5 and this for a constant outlet pressure at the outlet 10 of the compressor element.

It follows from this that at a certain speed n the flow Q increases with the inlet pressure $p_{in}$ and that at a certain imposed inlet pressure $p_{set}$ the flow Q increases with the speed n.

Figure 3:
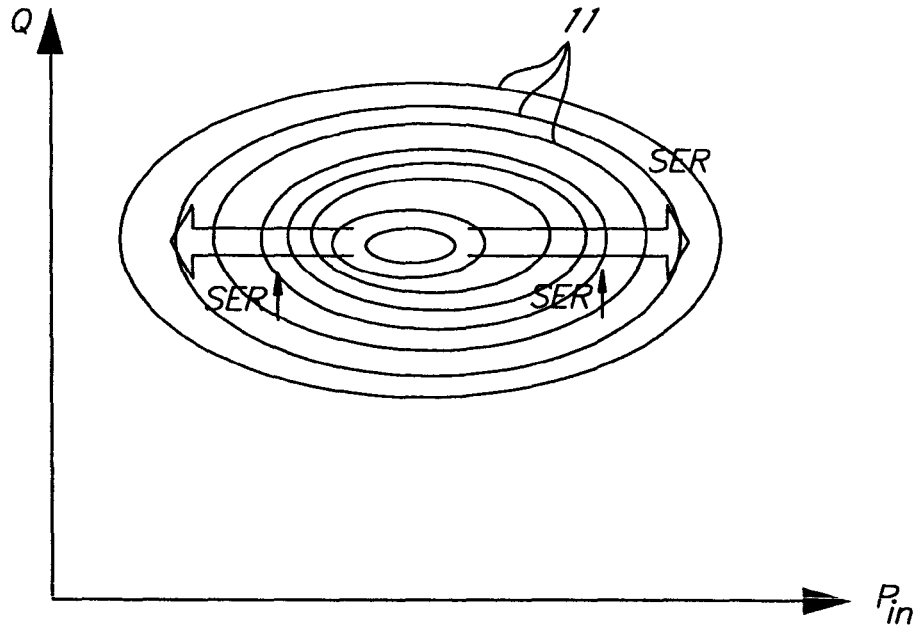

For the same compressor element 5, FIG. 3 shows the graph of the specific energy requirement (SER) as a function of the inlet pressure $p_{in}$ and the flow Q, whereby the concentric rings 11 present the curves of equal SER and whereby the SER increases from the centre ring 11 to the outermost ring 11.

The SER is expressed as being the required power P to be supplied by the motor 6 to compress a flow Q at an inlet pressure $p_{in}$ and is expressed in Joules/normal litre, for example.

It goes without saying that the SER is inversely proportional to the efficiency of the compressor element 5.

Figure 4:
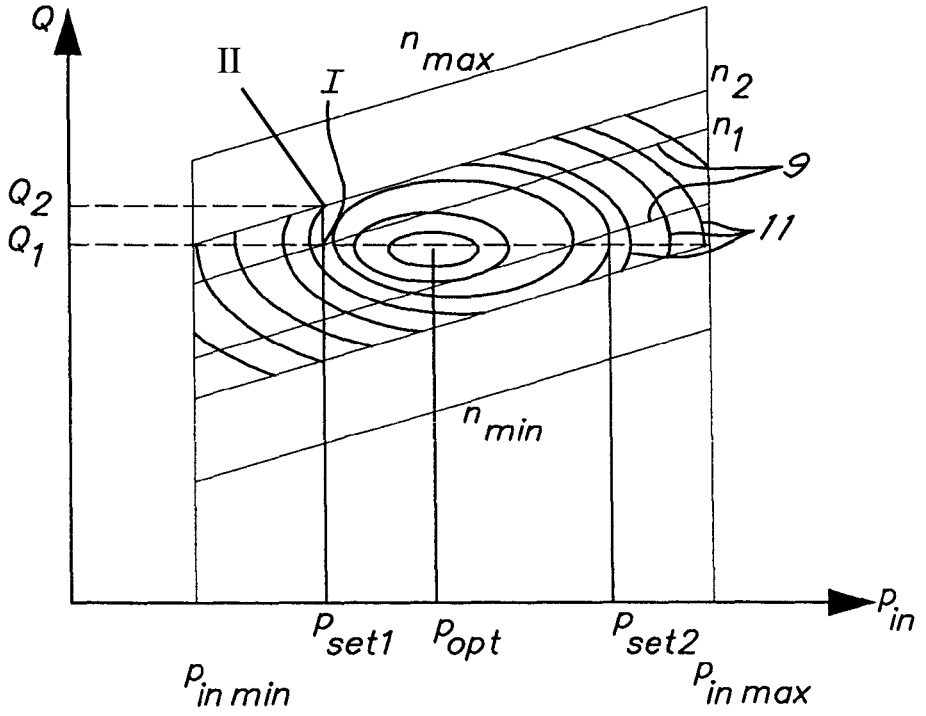

In FIG. 4 the two graphs of FIGS. 2 and 3 have been combined into a single drawing.

With known controllers the speed n of the compressor element 5 is controlled as a function of the available gas flow Q originating from the source 1 by:

- setting a desired value for the inlet pressure, for example the desired value $p_{set1}$ for FIG. 4, and
- controlling the speed n of the motor 6 by reducing the speed n when the inlet pressure $p_{in}$ is lower than the set desired value $p_{set1}$, or by increasing the speed n when the inlet pressure $p_{in}$ is higher than this set desired value $p_{set1}$, and this until the inlet pressure $p_{in}$ is equal to the set desired value $p_{set1}$.

In this way it can be ensured that the available flow Q is also fully supplied to the network 2.

Indeed, if when starting from the operating point I in FIG. 4 at a flow Q1, a speed $n_1$ and a desired value $p_{set1}$, the available flow Q supplied by the source 1 increases to Q2 in FIG. 4 for example, the inlet pressure $p_{in}$ will increase for a constant outlet pressure.

In this case, according to the aforementioned known controller the speed n will increase to $n_2$ such that a new steady operating point II is reached at a higher flow Q2 that is equal to the available flow.

For a given available flow Q1, by setting $p_{set}$ an operating region can be overlapped that is defined in FIG. 4 by the parallelogram bounded by the aforementioned values $p_{inmin}$ and $p_{inmax}$ and by the operating lines of the speed going through the extreme operating points Q1,$p_{inmin}$ and Q1,$p_{inmax}$.

In practice, with known screw compressors two desired values are set for the inlet pressure $p_{in}$, for example, for example pset1 and pset2 in FIG. 4.

It is clear that with these desired values the corresponding SER in FIG. 4 is not optimum and that according to the known control of the speed n as a function of one or two desired values of the inlet pressure $p_m$, it will only operate in optimum conditions of minimum SER by chance as these optimum conditions also depend on the available flow Q.

The invention presents a comparable control as described above, but with the difference that the desired value of the inlet pressure $p_{set}$ is adjusted on the basis of the aforementioned characteristic data and in such a way that after the aforementioned control of the speed at the adjusted desired value $p_{set}$ of the inlet pressure, the efficiency of the compressor is a maximum, or in other words the SER is a minimum.

In the case of FIG. 4 this adjusted desired value for a flow Q1 corresponds to the optimum desired value $p_{opt}$, which in reality is a function of the available flow Q.

In order to enable this control, the controller 7 is provided with:

- an input 12 for a signal that is representative of the inlet pressure $p_{in}$ that originates for example from a pressure sensor 13 at the inlet 8 of the compressor 4;
- an input 14 for a signal that is representative of the speed n of the compressor element 5 or the motor 6 with a controllable variable speed and which for example originates from a tachometer 15;
- a desired value $p_{set}$ for the inlet pressure $p_{in}$ to be set at 16;
- an output 17 for the control signal $n_{set}$ for the desired speed of the compressor element 5;
- an algorithm 18 for controlling the speed n of the compressor element 5 by reducing the speed n when the inlet pressure $p_{in}$ is lower than the desired value $p_{set}$ of the inlet pressure, or by increasing the speed n when the inlet pressure $p_{in}$ is higher than the desired value $p_{set}$ of the inlet pressure $p_{in}$, until the inlet pressure $p_{in}$ is equal to the desired value $p_{set}$;
- a memory 19 in which the characteristic data of the compressor element 5 are stored, for example in the form of the graph of FIG. 4 or in tabular or formula form, whereby this graph is preferably stored in the memory 19 beforehand; and,
- an additional algorithm 20 to determine the value $p_{opt}$ of the desired value $p_{set}$ of the inlet pressure on the basis of the aforementioned characteristic data in the memory 19 and to adjust this accordingly such that the compressor 4, after controlling the speed n using the algorithm 18 with the desired value $p_{opt}$, consumes the least power P to compress the available gas flow and to supply it to the network 2.

In this way the producer of the gas is assured that the entire available flow of gas can always be supplied to the network 2 and this with the lowest specific consumption.

Figure 5:
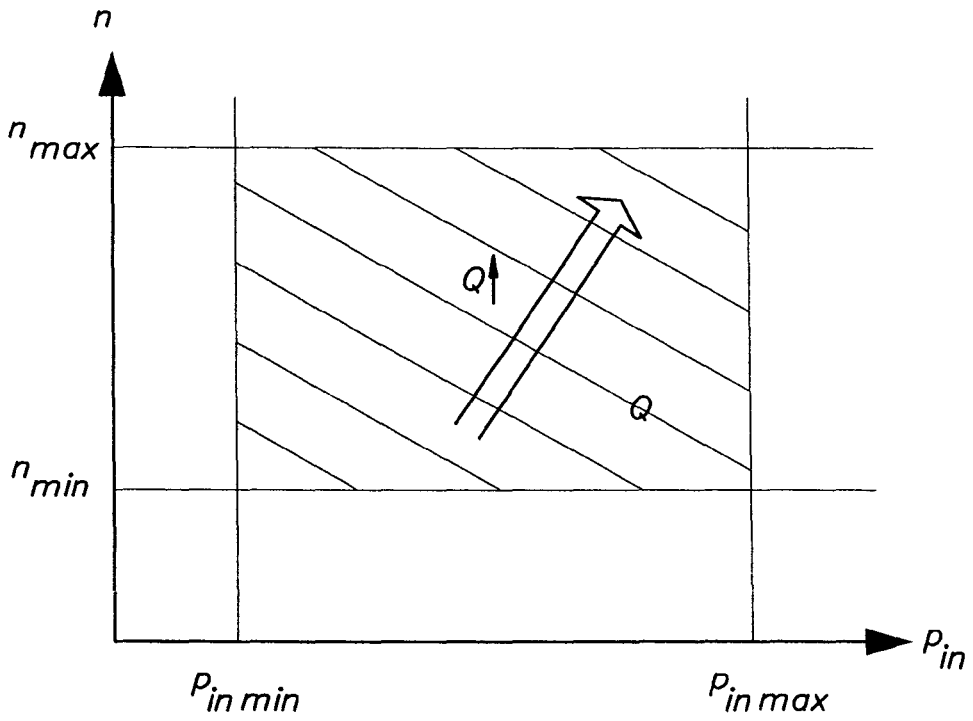
Figure 6:
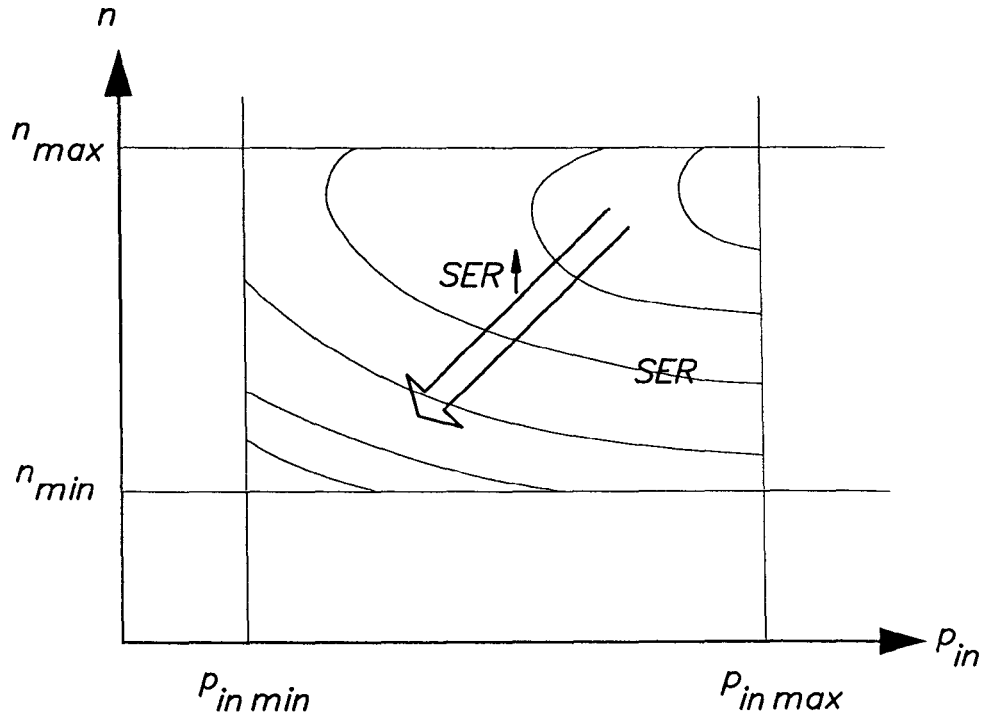
Figure 7:
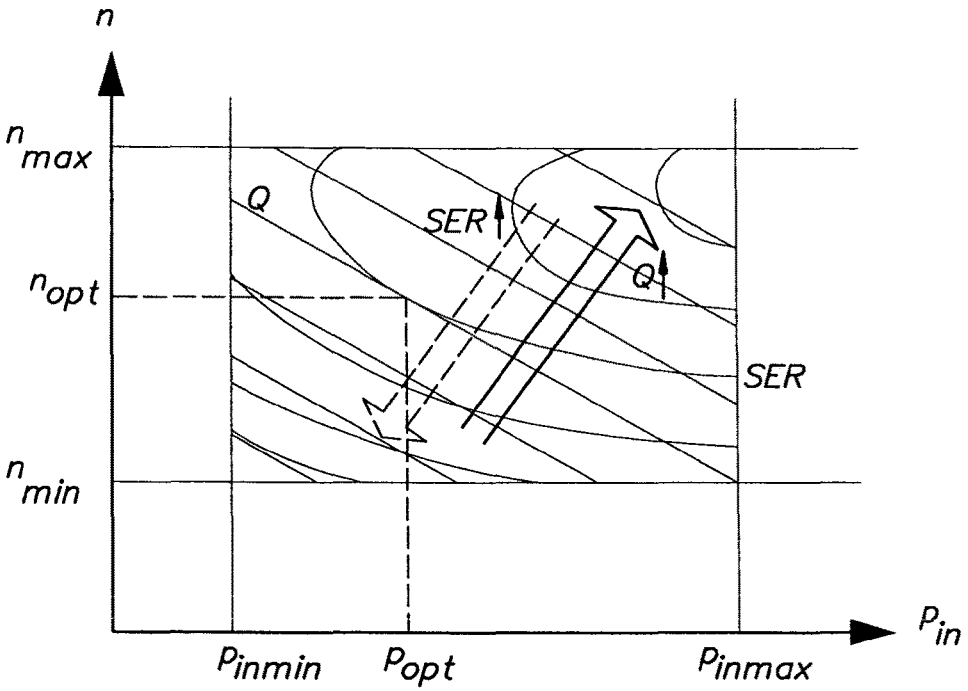

FIGS. 5 to 7 show an alternative or additional form of the characteristic data of the compressor element 5 that could be stored in the memory 19. In this case in FIG. 5 these characteristic data are stored in the form of diagrams with an inlet pressure $p_{in}$ and speed n that show the operating curves along which the flow Q and the SER respectively are constant, and in FIG. 7 both diagrams are shown in one single diagram.

Instead of the SER the efficiency can also form part of the aforementioned characteristic data of the compressor element 5.

Instead of determining or calculating the characteristic data experimentally beforehand, a self-learning intelligent controller 7 can be used that determines these characteristic data, of FIG. 4 for example, point by point during the use of the compressor 4 and stores them in the memory 19 in the form of a graph or table.

Figure 8:
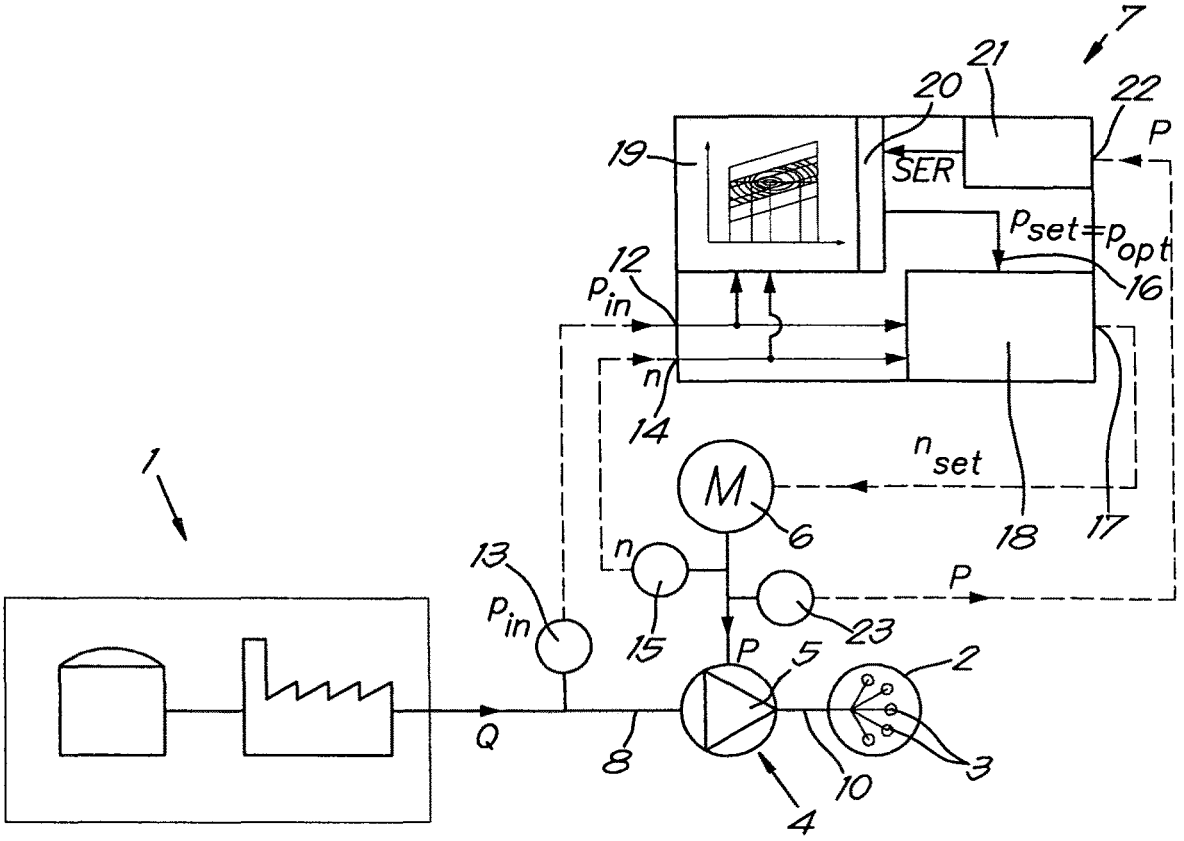
FIG. 8 shows an arrangement such as that of FIG. 1, but with a variant embodiment of a compressor according to the invention.

To this end the controller 7 can also be equipped with a second additional algorithm 21, as shown in FIG. 8, to automatically determine the aforementioned characteristic data such as the SER of the compressor 4 concerned during the use thereof and to store them point by point in the memory 19 of the controller.

In this respect the intelligent controller 7 can be provided with an additional input 22 for a signal that is representative of the power P supplied to the compressor element 5 that originates from a transducer 23 for example, whereby this signal is used by the additional algorithm 21 to determine the SER and to store it in the memory 19 with the characteristic data as a function of the speed n and the inlet pressure $p_{in}$.

To this end, in the second additional algorithm 21 a program can be integrated to allow the compressor 4 to successively operate at different operating points within the operating region of the compressor by setting the corresponding desired value of the inlet pressure and speed for each operating point, for example in incremental steps.

It goes without saying that the algorithm 21 can be used once when commissioning a compressor 4, after which the transducer 23 can be removed, but this algorithm 21 can also be used continually or occasionally during the lifetime of the compressor 4 to continuously update the characteristic data in the memory 19 in order to take account of the effect of wear on the SER for example.

Although the invention is primarily applicable to screw compressors, the method described and the intelligent controller 7 thereby applied can also be used with other types of compressors.

The present invention is by no means limited to the embodiments described as an example and shown in the drawings, but such a method according to the invention for controlling the speed of a compressor as a function of the available gas flow and a controller and compressor thereby applied can be realised according to different variants without departing from the scope of the invention.

The invention claimed is:

1. A controller for controlling a speed of a compressor as a function of an available flow of gas originating from a source, comprising:

an input for a signal that is representative of an inlet pressure at an inlet of the compressor;

an input for a signal that is representative of the speed of the compressor;

a desired value to be set for the inlet pressure, and, wherein the controller is configured to control the speed of the compressor by reducing the speed when the inlet pressure is less than the set desired value of the inlet pressure, or by increasing the speed when the inlet pressure is greater than the set desired value of the inlet pressure until the inlet pressure is equal to the set desired value, wherein the controller further comprises:

a memory in which a characteristic data of the compressor are stored or can be stored that relate to an efficiency and/or a specific energy requirement of the compressor, which is a ratio of a power supplied to the compressor to a compressed gas flow supplied, as a function of the speed and the inlet pressure; and, wherein the controller is further configured to calculate an adjusted desired value of the inlet pressure to adjust the set desired value, the adjusted desired value corresponding to a maximum of an efficiency of the compressor or to a minimum of a specific energy requirement after the control of the speed at the adjusted desired value of the inlet pressure.

2. The controller according to claim 1, wherein the controller is further configured to automatically determine the characteristic data of the compressor during a use of the compressor and to store them point by point in the memory of the controller.

3. The controller according to claim 2, wherein it is provided with an additional input for a signal that is representative of the power supplied to the compressor, whereby this signal is used by the controller to determine the efficiency and/or the specific energy requirement and to store or overwrite them in the memory with the characteristic data as a function of the speed and the inlet pressure.

4. The controller according to claim 1, wherein it is provided with a program to get the compressor to operate successively at different operating points in an operating region of the compressor by setting the corresponding desired value of the inlet pressure and the speed for each operating point in incremental steps.

5. A compressor comprising the controller according to claim 1.

6. The compressor according to claim 5, wherein the compressor is configured to supply gas originating from a source with a variable available flow to supply an entire available flow of gas from the source to a downstream network of consumers with the highest possible efficiency and/or the lowest possible specific energy requirement, which is the ratio of the power supplied to the compressor to the compressed gas flow supplied.

7. A method for controlling a speed of a compressor as a function of an available gas flow originating from a source, whereby the compressor is provided with a controller for controlling the speed, comprising the following steps:

setting of a desired value for an inlet pressure at an inlet of the compressor;

determining the inlet pressure at the inlet of the compressor;

determining the speed of the compressor;

controlling the speed of the compressor by reducing the speed when the inlet pressure is less than the set desired value of the inlet pressure, or by increasing the speed when the inlet pressure is greater than the set desired value of the inlet pressure until the inlet pressure is equal to the set desired value;

storing a characteristic data of the compressor relating to an efficiency and/or a specific energy requirement onto a memory of the controller, wherein the specific energy requirement is a ratio of a power supplied to the compressor to a compressed gas flow supplied, as a function of the speed and the inlet pressure;

calculating an adjusted desired value of the inlet pressure to adjust the set desired value, said adjusted desired value corresponding to a maximum of an efficiency of the compressor or to a minimum of a specific energy requirement after the control of the speed at the adjusted desired value of the inlet pressure.

8. The method according to claim 7, wherein the characteristic data of the compressor are determined beforehand and entered in the memory of the controller.

9. The method according to claim 7, wherein the characteristic data of the compressor are automatically determined during the use of the compressor and are stored in the memory of the controller.

10. The method according to claim 9, wherein to determine the characteristic data of the compressor during the use of the compressor, the efficiency and/or the specific energy requirement is determined for successive steady operating points and stored in the memory as a function of the speed and the inlet pressure.

11. The method according to claim 10, wherein to determine the efficiency and/or the specific energy requirement, the flow of compressed gas and the power supplied to the compressor to drive the compressor are determined.

12. The method according to claim 9, wherein at least during a commissioning of the compressor, the characteristic data of the compressor are determined over an entire operating region of the compressor and are stored in the memory.

13. The method according to claim 12, wherein to determine the characteristic data of the compressor over the entire operating region of the compressor, the controller is provided with a program to get the compressor to operate successively at different operating points within the operating region by setting the corresponding desired value of the inlet pressure and the speed for each operating point, according to incremental steps.

14. The method according to claim 7, wherein it is applied to a screw compressor.

15. The method according to claim 7, wherein it is applied to a supply of gas originating from a source with a variable available flow, in order to be able to supply an entire available flow of gas from the source to a downstream network of users with the highest possible efficiency and/or with the lowest possible specific energy requirement.

16. The method according to claim 7, further comprising a step of adjusting the set desired value of the inlet pressure.

* * * * *